US010054294B2

(12) United States Patent
Owens

(10) Patent No.: US 10,054,294 B2
(45) Date of Patent: Aug. 21, 2018

(54) LIGHT FIXTURE COVERING ASSEMBLY

(71) Applicant: Lonnie Owens, El Dorado, KS (US)

(72) Inventor: Lonnie Owens, El Dorado, KS (US)

( * ) Notice: Subject to any disclaimer, the term of this patent is extended or adjusted under 35 U.S.C. 154(b) by 0 days.

(21) Appl. No.: 15/381,891

(22) Filed: Dec. 16, 2016

(65) Prior Publication Data

US 2017/0097144 A1 Apr. 6, 2017

(51) Int. Cl.
*F21V 17/06* (2006.01)
*F21V 23/00* (2015.01)

(52) U.S. Cl.
CPC ..... *F21V 17/06* (2013.01); *F21V 23/002* (2013.01)

(58) Field of Classification Search
CPC ..... F21V 17/104; F21V 17/06
USPC ..... 362/374
See application file for complete search history.

(56) References Cited

U.S. PATENT DOCUMENTS 3,887,802 A * 6/1975 Goralnik ..... F21S 8/033 220/478
5,405,169 A * 4/1995 Schwartz ..... B42F 11/00 281/15.1
5,997,158 A 12/1999 Fischer et al.
6,168,300 B1 1/2001 Fischer et al.
6,422,720 B2 7/2002 Fischer et al.

* cited by examiner

*Primary Examiner* — Christopher Raabe
(74) *Attorney, Agent, or Firm* — Kenneth H. Jack; Davis & Jack, L.L.C.

(57) ABSTRACT

A light fixture covering assembly for attachment to differently sized square light fixture boxes, the assembly incorporating a "T" plate having a column and lateral arms having a length equal to a side length of a largest square light fixture box, wherein the ends of the "T" plate's arms form frangible tabs having lengths equal to one-half of the difference of the side length of the largest box and a side length of a smaller box; and incorporating a rectangular plate formed wholly with the "T" plate's column, the rectangular plate having a lateral dimension matching dimensions of the smaller box, and having a longitudinal dimension equal to the small box's dimension less the height of the "T" plate's arms.

9 Claims, 6 Drawing Sheets

LIGHT FIXTURE COVERING ASSEMBLY

FIELD OF THE INVENTION

This invention relates to overhead commercial lighting. More particularly, this invention relates to ceiling mounted box configured commercial lighting fixtures.

BACKGROUND OF THE INVENTION

Overhead commercial lighting fixtures commonly comprise a downwardly opening square box attached to a ceiling surface, such fixtures having a removably attached floor plate or cover plate which supports electrical lighting elements. Such light fixtures' floor plates, along with electrical lighting components often become degraded or obsolete, giving rise to a need for replacement. In many circumstances, the downwardly opening square box component of the lighting fixture is most conveniently left in place, such box components typically being in less need of replacement.

Such downwardly opening square box commercial lighting fixtures commonly have slightly varying sizes which gives rise to difficulties in providing and installing replacement components. Upon proper sizing of a replacement floor and lighting element unit, difficulties remain in wiring the new lighting unit while holding such unit immediately below the fixture box.

The instant inventive light fixture covering assembly solves or ameliorates the problems discussed above by providing a specialized electric light supporting panel having modular components which enable the panel to be variably attached to differently sized square boxed light fixtures, and to conveniently temporarily suspend from such boxes.

BRIEF SUMMARY OF THE INVENTION

Light fixtures in the form of downwardly opening sheet steel boxes are commonly installed upon the undersurfaces of ceilings of outdoor commercial structures such as gasoline station and convenience store canopies. Such fixtures commonly comprise a square peripheral wall which extends downwardly from such ceiling a distance between 5"-7", such fixtures commonly including a mounting flange which extends inwardly about the opening of the box. Such mounting flange commonly have a width or inward extension of approximately ½"-1".

LED, florescent, or incandescent light units are commonly supported by a mounting frame at the lower opening of such box configured light fixture. Such frame commonly comprises a square sheet steel plate which is closely fitted for nesting upward insertion into the lower opening of the square box light fixture, and for peripheral abutting contact with the box's peripheral mounting flange. Upon such nesting insertion of the fitted square plate, mounting screws are commonly upwardly extended through aligned screw receiving eyes for securing the plate and the electrical illuminating components to the fixture box.

A problem associated with the above described ceiling mounted light fixture boxes results from their variability in size. Within U.S. metropolitan areas, a large plurality of square light fixture boxes are commonly installed upon the undersurfaces of gasoline station canopies, each such box being configured substantially as described above. Among such plurality of installed light fixture boxes, many will be of a small dimension, such as a 21"×21" square, many will be of a relatively large dimension such as a 23"×23" square, and many more will be sized at an intermediate dimension, such as 22"×22". Also, within such plurality of differently sized light fixture boxes, many electronic light unit supporting floor plates will commonly be degraded, damaged, or obsolete, and will be in need of replacement.

The variability and square dimension sized of the above described light fixture boxes give rise to difficulties and challenges in the process of upgrading the electronic lighting units which are supported by such boxes. For example, a gas station owner having canopy mounted square boxes including florescent light supporting floor plates may wish to upgrade such lighting to include LED (light emitting diode) lighting units. Such owners may on occasion erroneously inform a lighting replacement contractor of the square dimensioned size of the overhead light fixture boxes, resulting in an erroneous provision of square floor plates having dimensions which are too large or too small. Such errors result in wastage of time and materials. Upon proper sizing, an installer is still typically confronted with difficulties holding replacement components below the overhead box fixture while making wiring connections.

To ameliorate such problems, the instant invention provides a "T" plate structure having a longitudinal column having a base, and having left and right or lateral arms. In a preferred embodiment, the "T" plate's lateral arms extend leftwardly and rightwardly to span a distance which is equal to the inside dimension of a large size box fixture. For example, the large box fixture may have an inside dimension of 23", resulting in an approximately 23" wide "T" plate arm span. In order to allow such "T" plate to be inserted into a smaller 21"×21" box, 1" frangible tabs may be formed at the distal ends of each of the arms.

According to the function of such frangible tab adapted "T" plate arms, a lighting installer may break the tabs from the ends of the arms, advantageously shortening the effective lateral span on the "T" plate. Such "T" arm trimming allows the "T" arms to be inserted into the interior of a small 21"×21" box light fixture for hooking engagements with such fixture's mounting flanges.

In order to allow the invention's "T" plate component to be further alternatively installed within an intermediate or mid-sized 22" square light fixture box, each of the invention's frangible tabs may be configured to include a distal mid-sizing tab of approximately ½" in lateral length (such length being half of the size differential of the large and mid-sized boxes).

In a preferred embodiment, the instant invention's "T" plate component functions as a "T" hook for temporarily suspending plate and attached electronic lighting unit structures, such suspension resulting from engagements of the "T" plate's arms with the box's opposing and inwardly extending plate mounting flanges. In order to facilitate such "T" hooking suspension, the column portion of the "T" plate component preferably has a longitudinal length sufficient to span the thickness of the square box's mounting flange. To allow the suspended components to freely pivot from a temporary downwardly suspended position to a substantially horizontal installed position, the "T" plate's column portion is preferably canted downwardly from the "T" arms. Such canting extension of the "T" column advantageously allows the distal ends of the "T" plate to pivot without binding to a position which overlies one of the fixture's mounting flanges while the previously suspended plate structures underlie the mounting flange.

Further structural components of the instant inventive light fixture covering assembly comprise a rectangular plate which is preferably fixedly attached to or formed wholly with the base of the "T" plate's column. In a preferred embodiment, a rectangular plate has a lateral dimension which is sized for a nesting upward insertion into a smallest commonly met square light fixture box such as the 21"×21" box described above. In a preferred embodiment, the rectangular plate component is laterally oblongated a distance with respect to its longitudinal dimension such that the lateral oblongation is substantially equal to the longitudinal height of the "T" plate's arms. To avoid mechanical interference of the canted "T" column with the inner edge of a fixture box's oppositely longitudinal mounting flange, such "T" arm height preferably is at least as great as the length of the mounting flange's inward extension. Accordingly, where such mounting flanges are ½"-1" in length, the "T" arm's longitudinal height may be sized at approximately 1". Upon such 1" "T" arm height sizing, the 1" dimension preferably represents the extent of the rectangular plate's lateral oblongation, the plate having a lateral width 1" greater than its orthogonal longitudinal dimension.

Where the "T" plate's and the rectangular plate's lateral dimensions are sized as described above for exemplary installation upon a 21"×21" light fixture box, the rectangular plate's longitudinal dimension preferably is approximately 20" in length. In the preferred embodiment, electronic lighting components, such as a light emitting diode unit having electrical conductor wire leads, may be preliminarily installed upon and included as a part of the invention's rectangular plate component.

In use of the instant inventive light fixture covering assembly, and assuming that the installation environment comprises a 21"×21" light fixture box, an installer may initially snap off both of the "T" plate's frangible tabs, advantageously configuring the "T" plate's lateral arm span to an approximate 21" dimension. Thereafter, the installer may easily and conveniently hook the "T" plate's arms over the upper surfaces of opposing flanges of the light fixture box, such hooking engagement allowing the rectangular plate and attached electronic lighting unit to temporarily suspend in a "hands free" fashion from the mounting flange. Thereafter, electrical conductor connections between the canopy's electrical wiring and the lighting unit's wire leads may be conveniently effected by a single installer. Thereafter, the rectangular plate and "T" plate combination may conveniently pivoted upwardly to nest within the lower interior space of the light fixture box. Thereafter, the rectangular plate may be securely fastened by mounting screws.

In order to accommodate for installation of the instant inventive light fixture covering assembly upon a larger square light fixture box such as a 23"×23" box, a segmented "U" plate is preferably provided, such "U" plate having lateral or left and right column segments, and having a base segment which spans between the lower or longitudinal ends of the two column segments. In the preferred embodiment, the "U" plate's column segments have equal lateral dimensions, and the "U" plate's base segment has a lateral dimension such that the cumulative sum of the three lateral dimensions substantially equals the length of a side wall of a large light fixture box such as the above described 23" box. In order to allow the invention's "U" plate's component to be alternatively sized for use upon a mid-sized light fixture box, such as a 22"×22" box, frangible sizing tabs are preferably provided at the ends of the "U" plate's segments.

In an alternative configuration of the instant inventive light fixture covering assembly, the segmented "U" plate component is provided in a modified form, while the "T" plate component is omitted. In the alternative configuration, an additional "U" plate column spanning plate is provided, such column spanning plate forming in combination with the "U" plate a segmented square frame. Such segmented frame may effectively upsize the rectangular plate from a smallest square dimension to a largest square dimension. Where the instant invention alternatively provides such segmented square frame, the ends of such frame's segments preferably include frangible sizing tabs which allow the rectangular plate and segmented square frame combination to be sized for installation upon a mid-dimensioned light fixture box, such as the above described 22" box.

Accordingly, objects of the instant invention include the provision of a light fixture covering assembly which incorporates structures as described above, and which arranges those structures in relation to each other in manners described above, for the achievement of the beneficial functions described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
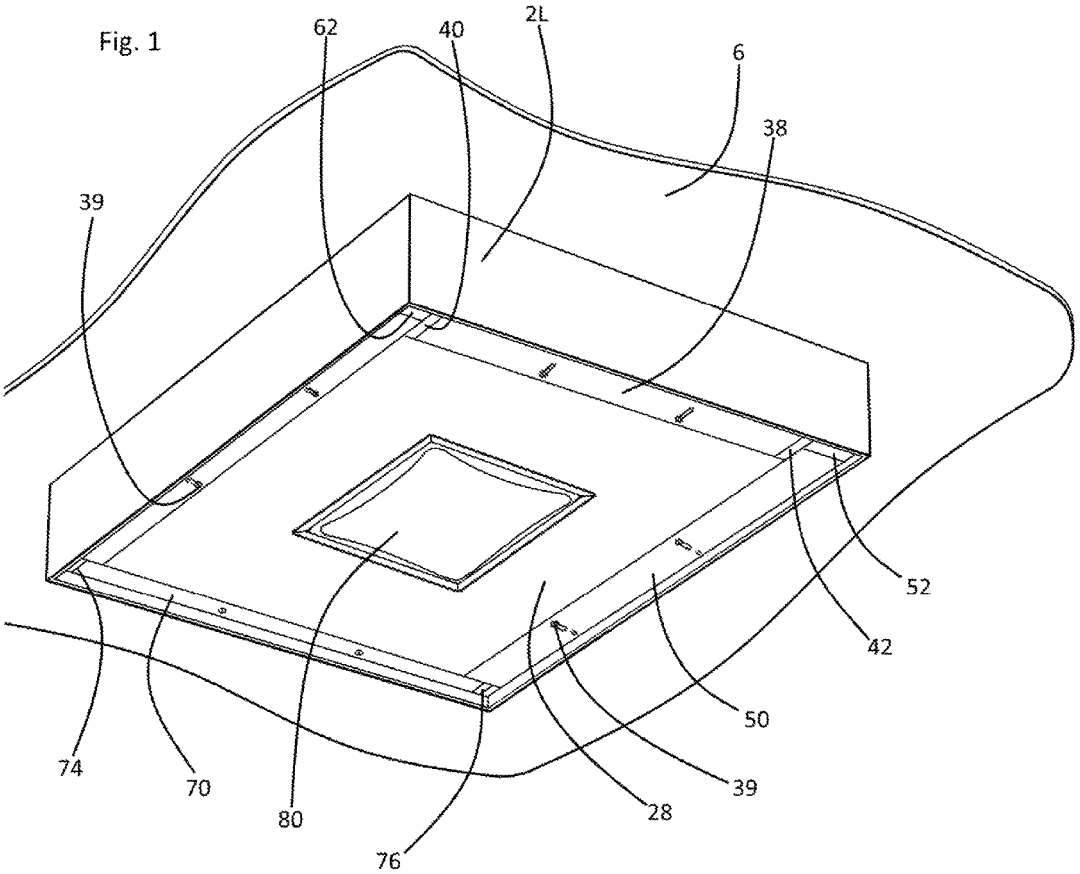
FIG. 1 is a perspective view of a preferred large box embodiment of the instant inventive light fixture covering assembly.
Figure 2:
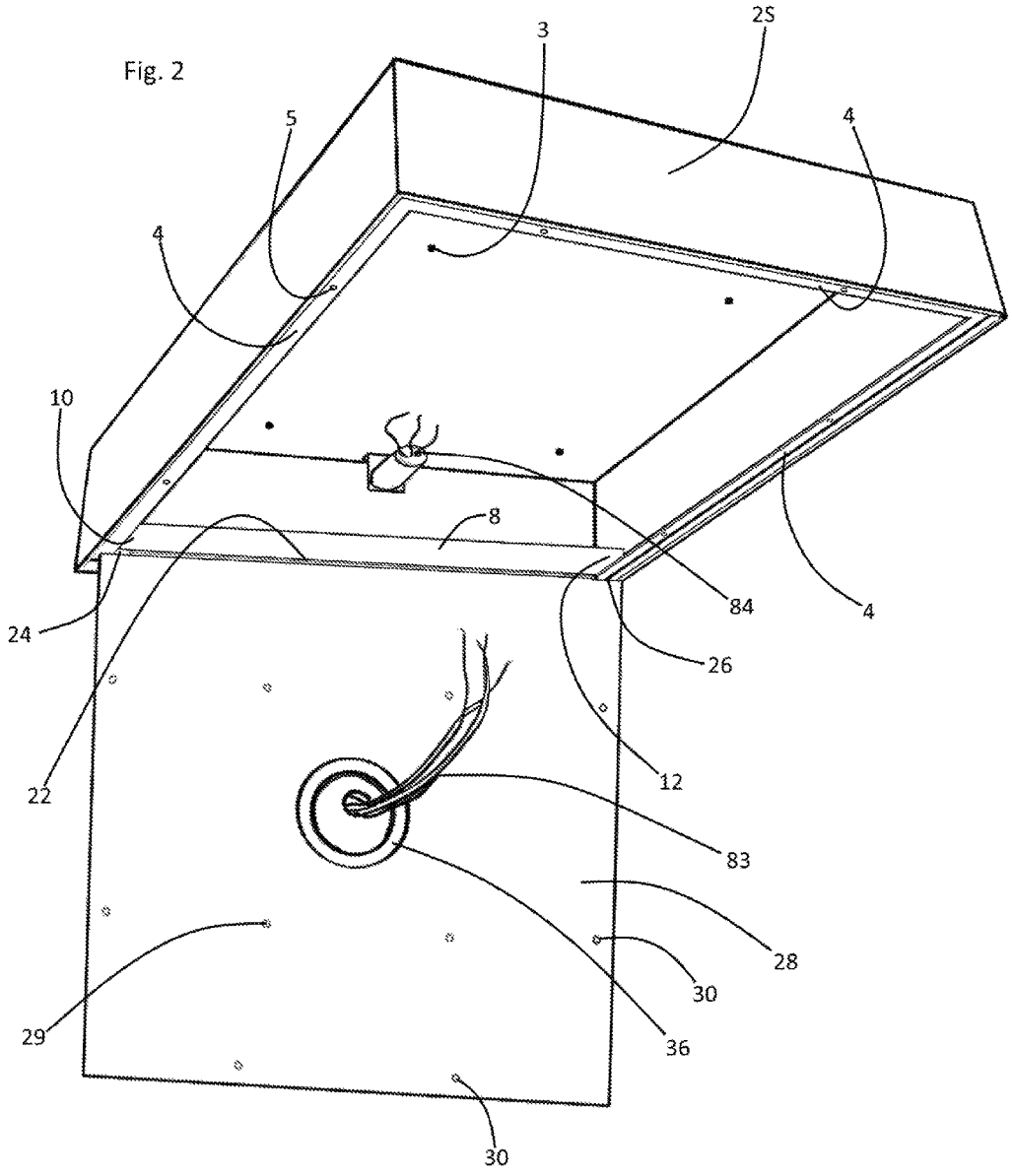
FIG. 2 presents an installation process view of a small box embodiment of the instant invention.
Figure 3:
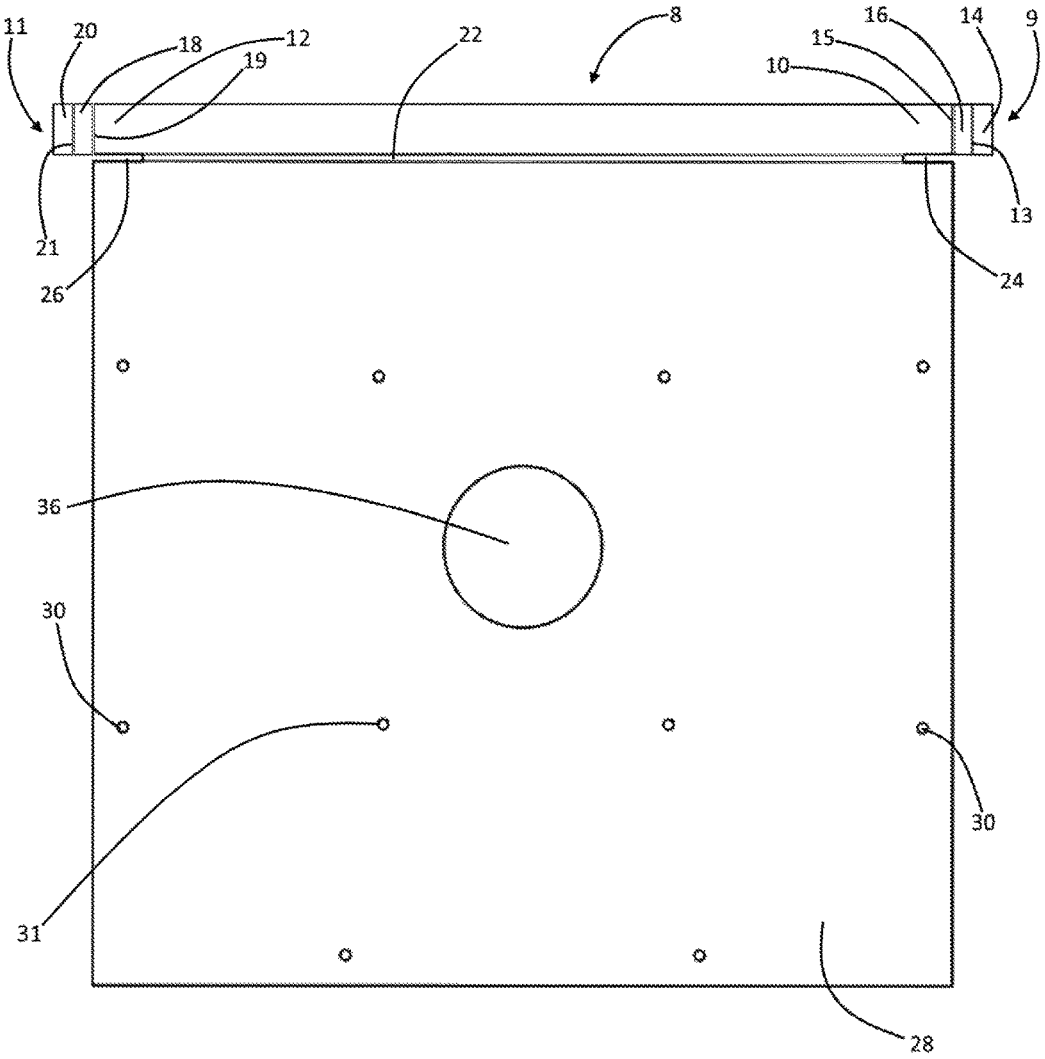
FIG. 3 presents an undersurface view of "T" plate and rectangular plate components of the FIG. 1 structure.
Figure 4:
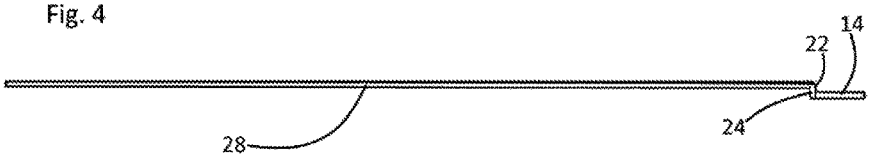
FIG. 4 is a side view of the structure depicted in FIG. 3.
Figure 5:
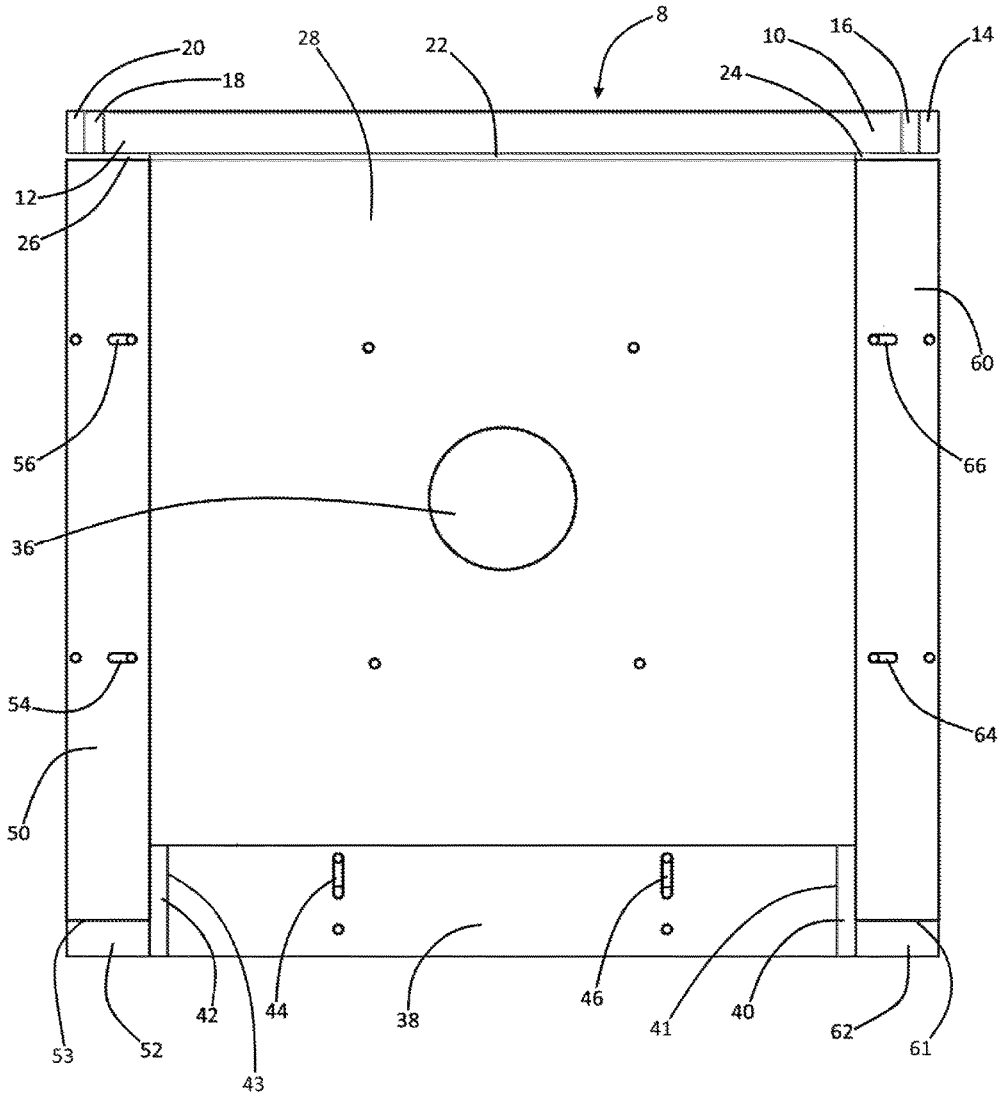
FIG. 5 redepicts the structure of FIG. 3 and additionally shows a segmented "U" plate component.

Referring now to Drawings FIGS. 1-3, a ceiling 6 is representative of the undersurface of a filling station or gas station canopy. An exemplary large 23"×23" light fixture box 2L and an exemplary small 21"×21" light fixture box 2S may be fastened by mounting screws 3 to the undersurface of the gas station canopy ceiling 6. Structural electrical wiring 84 from the station canopy extends into the interior of the box 2L or 2S. Such boxes have mounting flanges of approximately ½"-1" in width, such flanges having mounting screw eyes 5. The two depicted square boxes 2L and 2S are intended to be representative of a mid-sized square box light fixture having, for example, a 22" side wall dimension.

The instant inventive assembly preferably comprises a "T" plate component which is referred to generally by Reference Arrow 8. The "T" plate 8 has lateral flange hooking arms 10 and 12, the distal ends of such arms are preferably being specially adapted to include frangible tabs which are referred to generally by Reference Arrows 9 and 11. The lateral span of the "T" plate 8, including its frangible tabs 9 and 11, preferably approximates without matching or exceeding the interior side wall dimension of box 2L. Alternatively, manual breakage of the frangible tabs 9 and 10 at scores 15 and 19 may advantageously re-size the "T" plate for hooking engagements with the mounting flanges 4 of the smaller light fixture box 2S. Mid-sizing frangible tabs 14 and 20 are also preferably provided to allow alternative tab breaks at scores 13 and 21 to trim the "T" plate for hooking engagement within the side wall dimension of the above described mid-sized 22" light fixture box.

The instant invention's "T" plate component preferably comprises a centrally positioned and laterally oblongated column portion 22, such column portion preferably being canted slightly downwardly with respect to the "T" arms upon horizontal installation of the "T" plate. The arms of the "T" plate operatively engage and hook against laterally opposing mounting flanges 4 to allow underlying structures (described below) to suspend without any hand support applied by an installer. In order to avoid binding interference with the mounting flanges 4, the length of the "T" plate's column portion 22 is preferably sufficient to span the thickness of the mounting flanges 4. Such minimum length of the "T" plate column portion 22 advantageously forms mounting flange receiving slots 24 and 26, and the downward cant of the column advantageously allows for pivoting motions of rectangular plate 28 from the downwardly extended position depicted in FIG. 2 to the upwardly deflected and substantially horizontal position depicted in FIG. 1. During such motion, the "T" plate 8 in combination with the mounting flanges 4, advantageously functions as a pivot joint.

The oppositely longitudinal end of the rectangular plate 28 preferably is fixedly attached to or formed wholly with the base end of the "T" plate's column portion 22, such connection preferably centrally positioning the rectangular plate 28 between the distal ends of the "T" plate's arms 10 and 12. In the preferred embodiment, the rectangular plate is laterally oblongated to fit the side wall dimension of the small box 2S, the shorter longitudinal dimension of the rectangle having a lessened dimension equal to the longitudinal height of the "T" plate's arms 10 and 12. In the preferred embodiment, such height is sufficient to horizontally span the width of the mounting flanges 4, such dimension suitably being approximately 1". The rectangular plate 28 preferably has a central aperture 36 for wire lead passage, and has screw receiving eyes 31 for receipt of mounting screws 29 which securely mount an electronic light fixture 80 such as an LED light.

While the rectangular plate 28 and the LED light 80 suspend from mounting flanges 4 in the manner indicated in FIG. 2, electrical connections between wires 83 and 84 is easily achieved by a single installer whose hands are freed for such installation. Following such wiring connections, the rectangular plate may be pivoted upwardly, and mounting screws passing through screw eyes 30 and 5 may securely hold the rectangular plate 28 and light 80 at its horizontal installed configuration.

Figure 6:
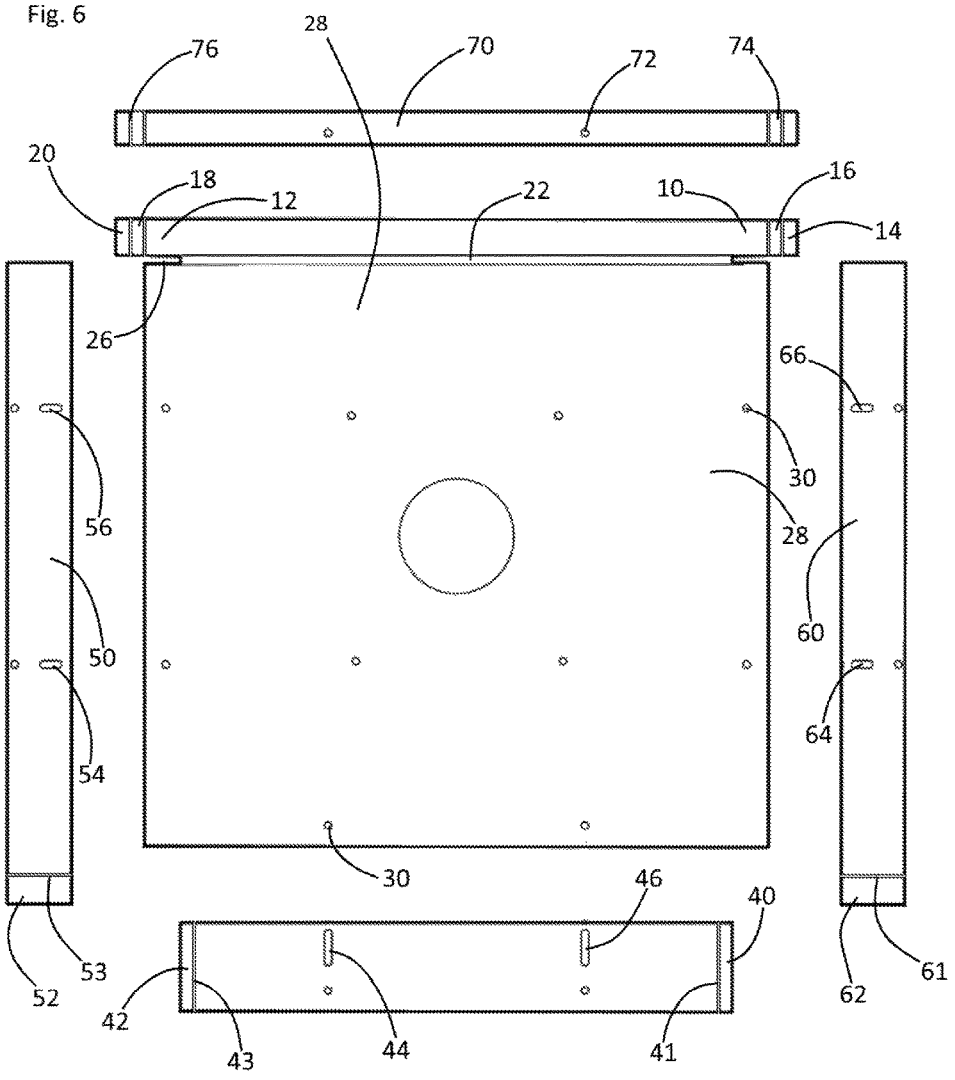
FIG. 6 is an exploded view of the FIG. 5 structure, the view of FIG. 6 additionally showing a cover plate.

To accommodate the larger 23"×23" box 2L, referring in particular to FIG. 6, the instant inventive assembly preferably further comprises a "U" plate which includes column segments 50 and 60, and a base segment 38. In the preferred embodiment, the sum of the lateral widths of such column and base segments equals the 22" side dimension the large 2L box. Screws 39 may secure the "U" plate segments 50, 38, and 60 to the rectangular plate 28, allowing the assembly to function with respect to the larger box 2L in a manner similar to the function of the rectangular plate 28 with respect to the smaller box 2S.

Mid-sizing frangible tabs 40, 42, 52, and 62 are preferably provided at ends of the "U" plate's segments, 50, 60, and 38, the frangible tabs 40 and 42 breaking at scores 41 and 43, and the frangible tabs 52 and 60 breaking at scores 53 and 61. For purposes of maintaining centralized positions of the plates 38, 50, and 60, the mid-sizing tabs of the base plate 38 are each ½ "in length and reside at either end of such plate. Mid-sizing tabs 52 and 62 are preferably 1" and reside at their plate's longitudinal ends. To accommodate alternative movements of the plates 50, 60, and 38 between their large sizing and mid-sizing positions, ½" travel slots 54, 56, 64, and 66 are provided upon the "U" plate's column segments, and 1" travel slots 44 and 46 are provided upon such plate's base segment.

To accommodate and cover the flange overlying position of the "T" plate's arms 10 and 12 in the installed configuration of FIG. 1, a cover plate 70 is preferably provided. Such plate preferably has small sizing and mid-sizing frangible tabs 74 and 76 which advantageously allow a single cover plate 70 to be utilized alternatively with small square light fixture boxes, large square light fixture boxes, and a mid-sized light fixture box.

Figure 7:
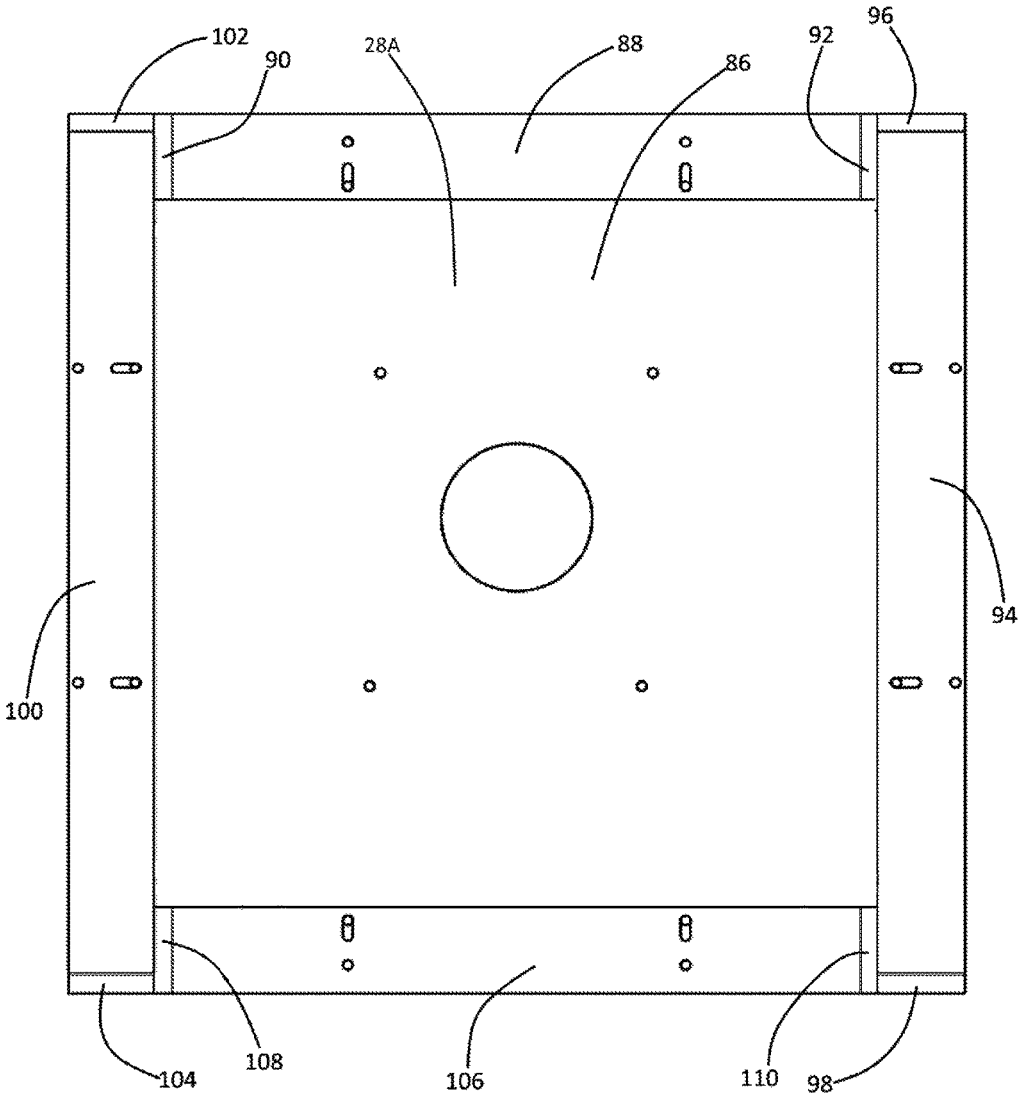
FIG. 7 presents an alternative modular plate configuration.

In the alternative configuration of the instant invention represented by FIG. 7, plate 28A is square, having dimensions matching the interior square dimensions of the small light fixture box 2S. In the FIG. 7 alternative, the segmented "U" plate component of FIG. 6 is substantially provided via column plates 94 and 100, and base plate 106. The "T" plate of FIGS. 1-6 is eliminated, and a fourth plate 88 is provided. Such plate 88, in combination with "U" plate 94, 100, 106, advantageously forms a segmented square frame. In a preferred embodiment, the square dimensions of the segmented square frame 88, 106, 94, 100 match the side wall dimensions of the large square box fixture 2L. To accommodate a 22" mid-sized square light fixture box, ½" frangible tabs 90, 92, 108, 110, 104, 102, 96, and 98 are preferably provided, the breakage and removal of which may convert the 23"×23" segmented square frame to a 22"×22" segmented square frame.

While the principles of the invention have been made clear in the above illustrative embodiment, those skilled in the art may make modifications to the structure, arrangement, portions and components of the invention without departing from those principles. Accordingly, it is intended that the description and drawings be interpreted as illustrative and not in the limiting sense, and that the invention be given a scope commensurate with the appended claims.

The invention hereby claimed is:

1. A light fixture covering assembly for alternatively closing a plurality of differently sized square light fixture boxes, each square light fixture box having a peripheral flange having a thickness, the light fixture covering assembly comprising:

(a) a "T" plate having a longitudinal column having a base, the "T" plate further having lateral arms having a longitudinal dimension, and having a length substantially equal to a side length of a largest box among the plurality of differently sized square light fixture boxes, wherein distal ends of the "T" plate's arms comprise frangible tabs having lengths substantially equal to one-half of the difference of the side length of said largest box and a side length of a smallest box among the plurality of differently sized square light fixture boxes; and (b) a rectangular plate fixedly attached to or formed wholly with the base of the "T" plate's column, the rectangular plate having a lateral dimension substantially equal to the side dimension of the smallest box, and the rectangular plate having a longitudinal dimension substantially equal to said small box side dimension less a length substantially equal to the "T" plate arms' longitudinal dimension.

2. The light fixture covering assembly of claim 1 wherein the "T" plate's column is canted downwardly from the "T" plate's arms.

3. The light fixture covering assembly of claim 2 wherein the "T" plate's column is sized to span the mounting flange's thickness.

4. The light fixture covering assembly of claim 1 further comprising a segmented "U" plate adapted for attachment to the rectangular plate, the segmented "U" plate having a base segment and having lateral column segments having base ends, said base and lateral column segments having lateral dimensions which are cumulatively substantially equal to a side length of the largest square light fixture box.

5. The light fixture covering assembly of claim 4 wherein each of the "U" plate's lateral column segments has a longitudinal dimension substantially equal to the largest square light fixture's side dimension less the "T" plate arms' longitudinal dimension.

6. The light fixture covering assembly of claim 5 wherein each of the "T" plate's frangible tabs comprises a mid-sizing frangible tab, each mid-sizing frangible tab having a lateral dimension substantially equal to one-half of the differential of the side length of the largest square light fixture box side and a side length of a mid-sized square light fixture box.

7. The light fixture covering assembly of claim 6 wherein the "U" plate's base segment has frangible mid-sizing tabs having lateral dimensions substantially equal to the lateral dimensions of the "T" plate's mid-sizing frangible tabs.

8. The light fixture covering assembly of claim 7 wherein the base ends of the "U" bracket's lateral column segments comprise mid-sizing frangible tabs having longitudinal lengths substantially equal to the lateral dimensions of the "T" plate's frangible tabs.

9. The light fixture covering assembly of claim 8 wherein the adaptation of the segmented "U" plate to attach to the rectangular plate comprises a plurality of lateral travel slots, and a plurality of longitudinal travel slots, the lateral traveling slots having lengths substantially equal to the lateral dimensions of the "T" plate's mid-sizing frangible tabs, and the longitudinal travel slots having lengths substantially equal to the lateral dimensions of the "T" plate's frangible tabs.

* * * * *